US009506612B1

(12) United States Patent
Badley et al.

(10) Patent No.: US 9,506,612 B1
(45) Date of Patent: Nov. 29, 2016

(54) EMERGENCY LIGHTING FOR LIGHT EMITTING DIODE FIXTURES

(71) Applicants: Caleb Badley, Sharpsburg, GA (US); Claire O'Reilly, Peachtree City, GA (US); Reed Bradford, Peachtree City, GA (US); Christopher Michael Bryant, Social Circle, GA (US)

(72) Inventors: Caleb Badley, Sharpsburg, GA (US); Claire O'Reilly, Peachtree City, GA (US); Reed Bradford, Peachtree City, GA (US); Christopher Michael Bryant, Social Circle, GA (US)

(73) Assignee: Cooper Technologies Company, Houston, TX (US)

( * ) Notice: Subject to any disclaimer, the term of this patent is extended or adjusted under 35 U.S.C. 154(b) by 172 days.

(21) Appl. No.: 14/213,829

(22) Filed: Mar. 14, 2014

Related U.S. Application Data

(60) Provisional application No. 61/789,167, filed on Mar. 15, 2013.

(51) Int. Cl.
*F21L 4/02* (2006.01)
*F21S 9/02* (2006.01)

(52) U.S. Cl.
CPC ..... *F21S 9/024* (2013.01); *F21S 9/022* (2013.01)

(58) Field of Classification Search
CPC ..... F21S 9/022; F21S 9/024; F21V 19/042; F21V 23/0457; F21Y 2101/02; H02J 9/02; H02J 9/061
See application file for complete search history.

(56) References Cited

U.S. PATENT DOCUMENTS

| | | | | |
|---|---|---|---|---|
| 6,824,295 | B1 * | 11/2004 | Grondal | G09F 13/14 362/234 |
| 8,186,852 | B2 * | 5/2012 | Dassanayake | F21K 9/135 362/231 |
| 8,333,481 | B2 * | 12/2012 | Deng | H05B 35/00 315/86 |
| 8,395,304 | B2 * | 3/2013 | Hisayasu | F21V 19/004 313/46 |
| 8,764,219 | B2 * | 7/2014 | Hasan | F21V 31/005 362/184 |
| 8,814,376 | B2 * | 8/2014 | Nicolai | F21V 13/04 362/249.02 |
| 8,896,208 | B2 * | 11/2014 | Shew | H02J 9/065 315/166 |
| 9,080,747 | B1 * | 7/2015 | Hetrick | F21V 14/06 |
| 9,252,595 | B2 * | 2/2016 | Recker | H05B 33/0803 |
| 2004/0062055 | A1 * | 4/2004 | Rozenberg | F21S 8/024 362/555 |
| 2008/0246844 | A1 * | 10/2008 | Chan | F21K 9/13 348/152 |
| 2014/0268697 | A1 * | 9/2014 | Smith | F21K 9/135 362/183 |

* cited by examiner

*Primary Examiner* — Peggy Neils
(74) *Attorney, Agent, or Firm* — King & Spalding LLP

(57) ABSTRACT

A luminaire can comprise two different types of light emitting diodes ("LEDs"), for example a chip-on-board light emitting diode ("LED") and at least one discrete light emitting diode. The luminaire can have a normal mode of operation that utilizes utility power and an emergency mode of operation that utilizes battery power. The luminaire may transition from normal to emergency mode upon loss of the utility power. During normal operation, the luminaire can operate the chip-on-board light emitting diode using utility power. During emergency operation, the luminaire can operate the discrete light emitting diode using battery power, without operating the chip-on-board light emitting diode.

20 Claims, 3 Drawing Sheets

EMERGENCY LIGHTING FOR LIGHT EMITTING DIODE FIXTURES

CROSS REFERENCE TO RELATED APPLICATIONS

This application claims priority to U.S. Provisional Patent Application No. 61/789,167 filed Mar. 15, 2013 in the name of Caleb Badley, Claire O'Reilly, and Reed Bradford and entitled "Emergency Lighting for LED Fixtures with Size Constraints," the entire contents of which are hereby incorporated herein by reference.

FIELD OF THE TECHNOLOGY

Embodiments of the disclosure relate generally to lighting solutions, and more particularly to systems, methods, and devices for emergency lighting for light emitting diode ("LED") fixtures with size constraints.

BACKGROUND

Emergency lighting typically involves a back-up power source, such as a battery pack. However, conventional battery packs for emergency lighting are typically relatively large in size as they normally contain a charger and converter circuit in addition to one or more large batteries. The size constraints imposed by these large battery packs have been problematic but manageable inside traditionally large luminaires.

However, new luminaires designed specifically for light emitting diodes ("LEDs") are often configured thermally to reduce the overall size of the housing. Accommodating battery packs for emergency lighting with these smaller luminaire housings poses challenges. Conventional battery packs are generally are too large to fit inside newer luminaire housings designed for light emitting diodes. One approach to resolving this problem is to use a remote mounted battery pack for emergency lighting. However, remotely mounting the battery pack from the luminaire adds further complications.

Accordingly, need is apparent for improved emergency lighting fixtures that utilize light emitting diodes. Need exists for an improved light emitting diode luminaire that includes a battery pack to support emergency lighting operations. Need further exists for a compact, integrated luminaire suited for emergency lighting applications. A capability addressing one or more such needs, or some other related deficiency in the art, would support improved illumination systems and emergency lighting solutions.

SUMMARY

A luminaire can comprise a first type of light emitting diode and a second type of light emitting diode. The two different types of light emitting diodes can have different rates of energy consumption and light output. The first type may comprise one or more chip-on-board light emitting diodes that consume energy at a relatively high rate and emit a relatively large amount of light. The second type may comprise one or more discrete light emitting diodes that consume energy at a reduced rate and emit less light.

The luminaire can have a normal mode of operation that utilizes utility power and an emergency mode of operation that utilizes battery power. The luminaire may transition from the normal mode of operation to the emergency mode of operation upon loss of the utility power. During normal operation, the luminaire can operate the chip-on-board light emitting diode using utility power. During emergency operation, the luminaire can operate the discrete light emitting diode using battery power, without operating the chip-on-board light emitting diode. The battery power can come from an on-board battery pack, for example.

The foregoing discussion of luminaires is for illustrative purposes only. Various aspects of the present technology may be more clearly understood and appreciated from a review of the following text and by reference to the associated drawings and the claims that follow. Other aspects, systems, methods, features, advantages, and objects of the present technology will become apparent to one with skill in the art upon examination of the following drawings and text. It is intended that all such aspects, systems, methods, features, advantages, and objects are to be included within this description and covered by this application and by the appended claims of the application.

BRIEF DESCRIPTION OF THE FIGURES

Reference will be made in the below discussion to the accompanying drawings, in which.

Figure 1A:
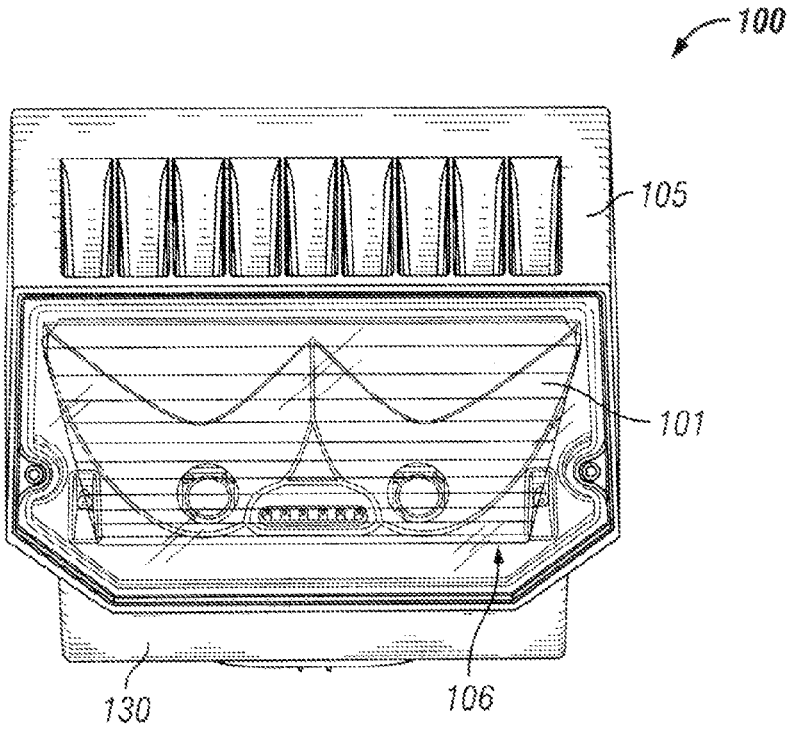
FIGS. 1A and 1B (collectively FIG. 1) illustrate bottom views of a luminaire in accordance with an example embodiment, where a lens of the luminaire is attached in FIG. 1A and removed in FIG. 1B.

Many aspects of the technology can be better understood with reference to the above drawings. The elements and features shown in the drawings are not necessarily to scale, emphasis being placed upon clearly illustrating the principles of exemplary embodiments of the present technology. Moreover, certain dimensions may be exaggerated to help visually convey such principles.

DETAILED DESCRIPTION OF EXAMPLE EMBODIMENTS

Some example embodiments disclosed herein relate to a light emitting diode luminaire or light fixture with emergency lighting features. For example, a compact luminaire can support emergency lighting using light emitting diodes.

Recent lighting technology has seen a trend towards lighting devices that use light emitting diodes as a primary light source. Light emitting diodes typically offer advantages over traditional light sources, such as increased energy efficiency, durability, compactness, and cost-effectiveness. One type of commonly used light emitting diode is a discrete light emitting diode, otherwise known as a standard light emitting diode. A second type of light emitting diode is a chip-on-board light emitting diode. The chip-on-board light emitting diode offers several advantages over the discrete light emitting diode. For example, chip-on-board light emitting diodes are generally more compact than discrete light emitting diodes, provide more uniform lighting, and facilitate improved thermal management. Thus, it can be beneficial to use chip-on-board light emitting diodes in certain lighting devices and fixtures.

Chip-on-board light emitting diodes also can offer greater light output, such that a single chip-on-board light emitting diode can provide a light output equivalent to an array of discrete light emitting diodes. However, in order to produce the greater light output, chip-on-board light emitting diodes have greater power demands than discrete light emitting diodes. Thus, a typical chip-on-board LED light source may produce more light and consume more energy than a typical LED array. As discussed in further detail below, such differences between two types of light emitting diodes (for example chip-on-board light emitting diodes and discrete light emitting diodes) can be used as an advantage in certain emergency lighting applications.

Embodiments of the disclosure now will be described more fully hereinafter with reference to the accompanying drawings, in which embodiments of the disclosure are illustrated. FIG. 1 illustrates an example embodiment. FIGS. 2 and 3 illustrate another example embodiment. This disclosure may, however, be embodied in many different forms and should not be construed as limited to the embodiments set forth herein; rather, these embodiments are provided so that this disclosure will be thorough and complete, and will fully convey the scope of the disclosure to those skilled in the art. Like numbers refer to elements that are like, but not necessarily identical, throughout.

Figure 1B:
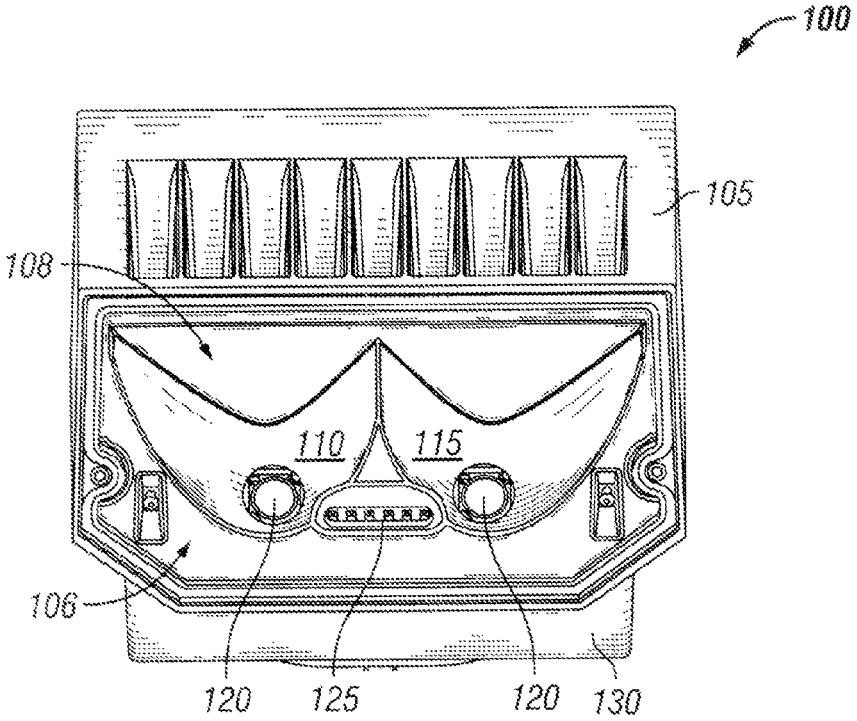

Turning now to FIG. 1, this figure illustrates bottom views of a luminaire 100 in accordance with an example embodiment. In the view of FIG. 1A, a lens 101 of the luminaire 100 is attached, while the lens 101 is removed in FIG. 1B.

The illustrated, example luminaire 100 includes a housing 105 and a light cavity 106. In the illustrated embodiment, the light cavity 106 is a cavity into which light is emitted. The light exits the light cavity 106 through the lens 101 that is situated at an aperture of the light cavity 106. The term "light cavity," as used herein, generally refers to a cavity from which light is emitted.

The light cavity 106 comprises a reflector 108 with two curved portions 110 and 115. Disposed proximate to the curved portions 110 and 115 of the reflector 108 are two chip-on-board light emitting diodes 120. Also disposed proximate to the reflector 108 is an array of discrete light emitting diodes 125. The discrete light emitting diodes 125 can be mounted on a printed circuit board that provides electrical power and control.

The example luminaire 100 also comprises a back box 130 that contains electrical components for the operation of the luminaire 100. A portion of the back box 130 can be seen in FIG. 1, as part of a housing 105 of the luminaire 100. The term "back box," as used herein, generally refers to a module, unit, enclosure, or box that is disposed at, near, or toward the rear or backside of a luminaire.

During a normal operation mode of the example luminaire 100, such as when normal utility power is available to the luminaire 100, the chip-on-board light emitting diodes 120 can be illuminated. In the normal operation mode for the luminaire 100, the discrete light emitting diodes 125 may or may not be illuminated. Thus, in one embodiment of the normal operation mode, the chip-on-board light emitting diodes 120 and the array of discrete light emitting diodes 125 simultaneously consume electricity and emit light. And in another embodiment of the normal operation mode, the chip-on-board light emitting diodes 120 consume electricity and emit light while the array of discrete light emitting diodes 125 are not consuming electricity or emitting light.

However, in an emergency operation mode, such as when utility power is not available, the luminaire 100 draws power from a battery pack (not shown in FIG. 1) that may be disposed in or attached to the housing 105, such as in the back box 130. In a typical application, the battery pack has enough power for 90 minutes of illumination. Various embodiments of the battery pack may be specified with sufficient electrical storage capacity to supply electrical power for different predetermined amounts of time, including in accordance with a government regulation, a product specification, or an industry standard, for example.

In the example embodiment shown in FIG. 1, in the emergency operation mode, the chip-on-board light emitting diodes 120 are kept in the off state and only the discrete light emitting diodes 125 are illuminated. While the discrete light emitting diodes 125 provide less light output than the chip-on-board light emitting diodes 120, the discrete light emitting diodes 125 provide adequate light output for the emergency operation mode. The discrete light emitting diodes 125 consume less power than the chip-on-board light emitting diodes 120 and can be combined to create a load appropriate to the illumination task and size of the battery capacity. Thus, the chip-on-board light emitting diodes 120 can be engaged when a relatively high level of illumination is needed or would be beneficial, such as in ordinary service; and the discrete light emitting diodes 125 can be engaged alone when a relatively low level of illumination will suffice and/or when power reserves are to be conserved, such as in an emergency situation that utilizes battery backup.

The discrete light emitting diodes 125 can also provide greater flexibility with respect to specifications for the battery pack, and the size and capacity of the battery pack stored in the back box 150 can be reduced. The compact battery pack is well suited to fit within thermally optimized dimensions of a light emitting diode luminaire, such as in the example illustrated in FIG. 1.

An additional benefit of integrating the discrete light emitting diodes 125 into the luminaire 100 with an integrated battery pack is the elimination of separate additional light fixtures dedicated for emergency lighting. Thus, the luminaire 100 can provide routine illumination and emergency illumination in a compact package.

Yet another benefit of integrating the discrete light emitting diodes 125 into the luminaire 100 with an integrated battery pack is a reduction in the level of maintenance needed as compared to other types of lighting systems with separate emergency lighting.

Figure 2A:
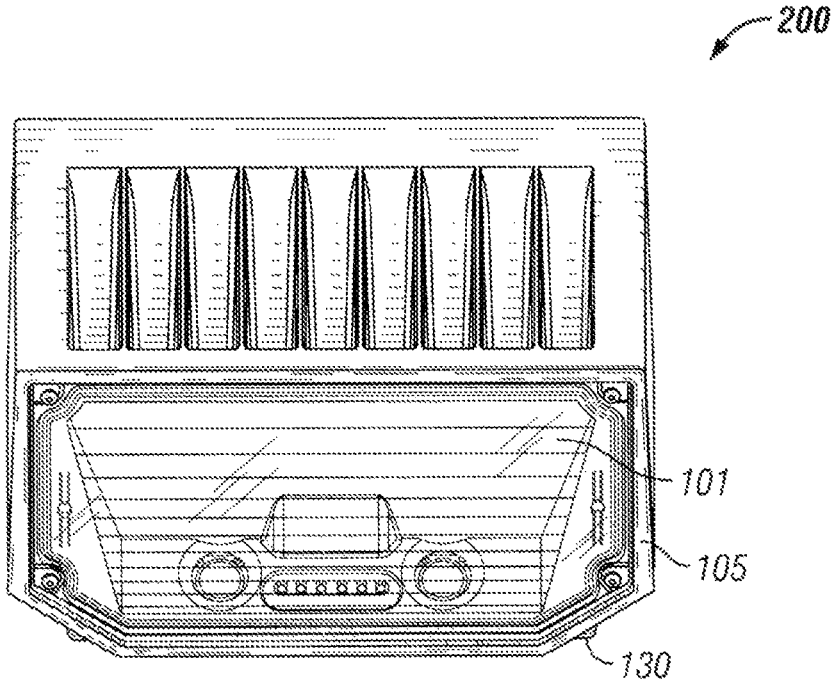
FIGS. 2A and 2B (collectively FIG. 2) illustrate bottom views of a luminaire in accordance with another example embodiment, where a lens of the luminaire is attached in FIG. 2A and removed in FIG. 2B.
Figure 2B:
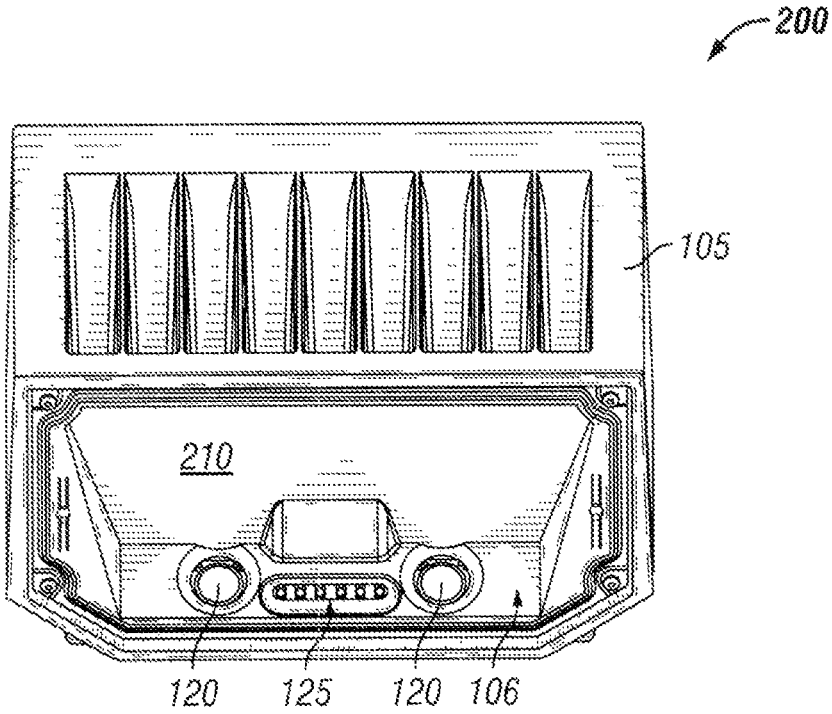

Turning now to FIGS. 2 and 3, another example embodiment of a light emitting diode luminaire 200 is illustrated. In the view of FIG. 2A, a lens 101 of the luminaire 200 is attached, while in FIG. 2B, the lens 101 is removed. As will be discussed in further detail below, FIG. 3 illustrates a perspective, cutaway view, in which the housing 105 of the luminaire 200 is opened so that representative internal features are visible.

Referring now to FIG. 2, the illustrated example luminaire 200 is similar to the luminaire 100 illustrated in FIG. 1 in that both comprise a housing 105, a back box 130 and a light cavity 106. However, the reflector 210 of the luminaire 200 has a different form from the reflector 108 of the luminaire 100. The two reflectors 210, 108 provide different illumination patterns as may be desired for different applications, for example. Nonetheless, the luminaire 200 also takes advantage of the different power demands of chip-on-board light emitting diodes 120 and discrete light emitting diodes 125.

The luminaire 200 includes two chip-on-board light emitting diodes 120 and an array of discrete light emitting diodes 125. As with the luminaire 100, the luminaire 200 can have a normal operation mode and an emergency operation mode.

In the normal operation mode, when utility power is available for the luminaire, the high power, chip-on-board light emitting diodes 120 can be illuminated and the lower power, discrete light emitting diodes 125 may or may not be illuminated. In the emergency operation mode, the chip-on-board light emitting diodes 120 will be in the off state, and only the discrete light emitting diodes 125 will be illuminated. Accordingly and as discussed above with reference to FIG. 1, a relatively small battery pack (not visible in FIG. 2) can be included in the back box 130 to power the discrete light emitting diodes 125 during the emergency operation mode. The luminaire 200 can operate in the emergency operation mode when utility power is lost or in response to an occurrence of some other emergency condition that may be triggered manually or automatically, for example.

Figure 3B:
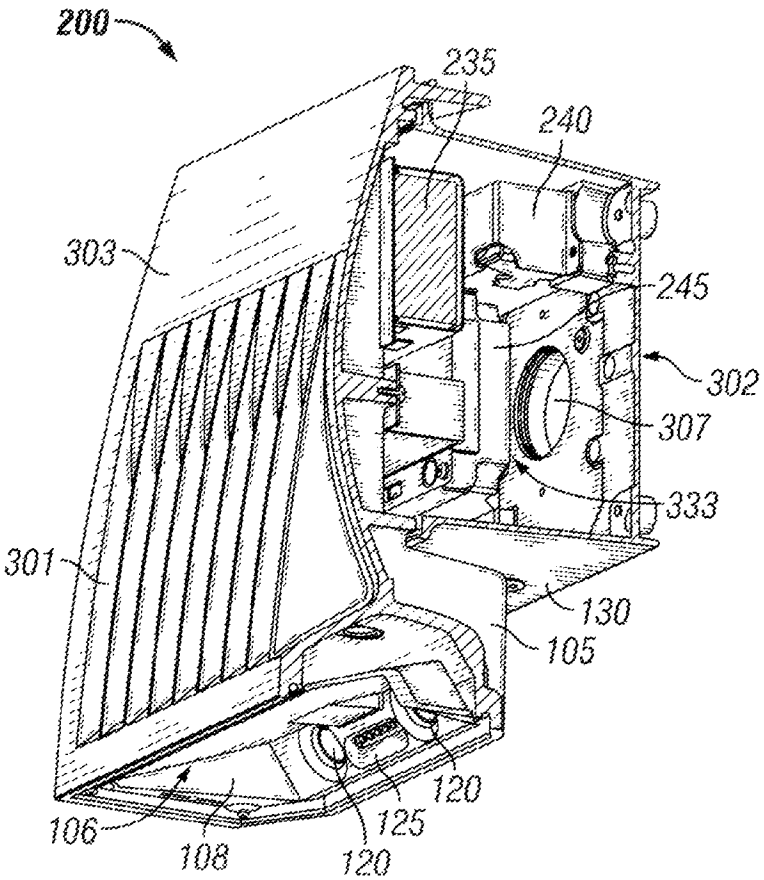
FIGS. 3A and 3B (collectively FIG. 3) illustrate a cutaway perspective view of a luminaire in accordance with an example embodiment, where a lens of the luminaire is attached in FIG. 3A and removed in FIG. 3B.
Figure 3A:
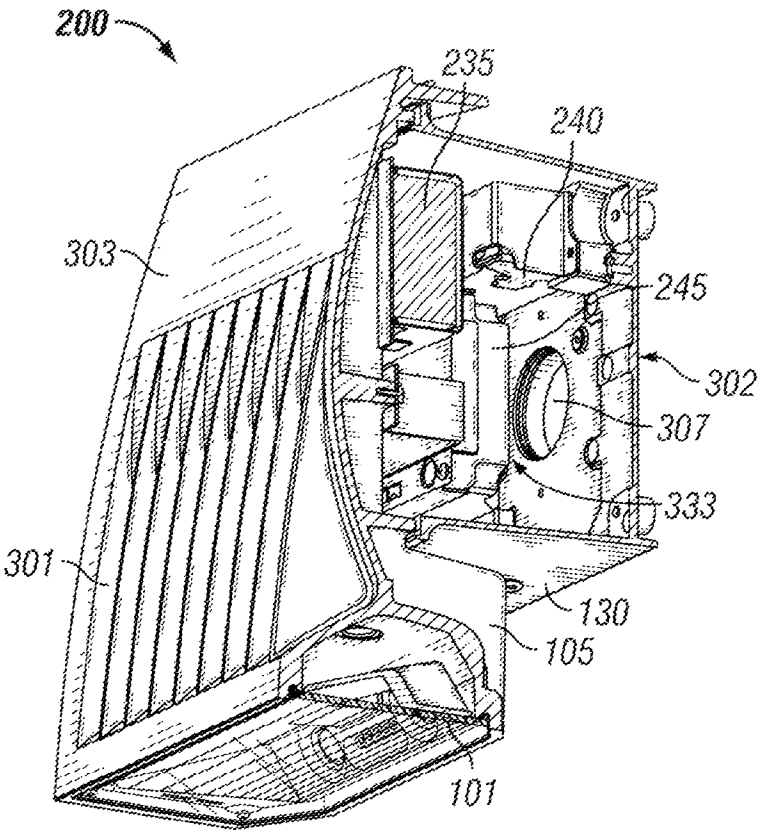

Referring now to FIG. 3, a cutaway, perspective view of the example luminaire 200 is illustrated. As discussed in further detail below, the cutaway opens the housing 105, including the back box 130, to provide a view of an example embodiment of an electrical system 333 for the luminaire 200. In the view of FIG. 3A, the lens 101 is attached, while in the view of FIG. 3B, the lens 101 is removed.

In keeping with the view of FIG. 2, the housing 105, the light cavity 106, and the back box 130 of the luminaire 200 are visible in FIG. 3. The chip-on-board light emitting diodes 120 and the discrete light emitting diodes 125 positioned with the light cavity 106 are likewise visible in the side perspective view provided in FIG. 3.

In certain example embodiments, the housing 105 acts as a heat sink. In the illustrated embodiment, the housing 205 includes a front side 303 and an opposing backside 302. The example front side 303 includes fins 301 that may extend vertically along all or a portion of the front side 303 of the housing 105.

The back box 130 portion of the housing 105 can include facilities for mounting the luminaire 200. For example, the back box 130 can include facilities on the back surface for mounting the luminaire 200 on a wall or other structure. In an example embodiment, such facilities can comprise one or more attachment apertures sized to accommodate screws, bolts, clips, or other appropriate fasteners.

In an example embodiment, the back box 130 can be removably coupled at the backside 302 of the housing 105. In a representative installation, the back box 130 can be mounted to a wall, and then the remaining portion of the housing 105 can be attached to the mounted back box 130. Thus, the luminaire 200 can comprise two housing portions that are coupled together during luminaire installation.

In the illustrated embodiment, the back box 130 comprises an aperture 307 through which electrical supply lines may pass. Alternating current (AC) electrical wires may couple to the luminaire 200 through the aperture 307, for example. In an example embodiment, the AC lines feed through the aperture 307 with the back box 130 mounted. The lines are attached to the electrical system 333 of the luminaire 200, and then the front housing portion is attached to the already-mounted back box 130.

In the example embodiment shown in FIGS. 2 and 3, the chip-on-board light emitting diodes 120 and the discrete light emitting diodes 125 can emit light from the light cavity 106 in a generally downward direction. Thus in some example installations, the luminaire 200 may be installed with the light cavity 106 facing down. As shown in FIG. 3A, the lighting cavity 106 can also include a lens 101 covering the light cavity 106 from the bottom side of the housing 105. In certain example embodiments, the lens 101 may be a glass, acrylic, or polycarbonate lens.

The example embodiment 200 of FIG. 3 illustrates example components of the electrical system 333, which is disposed in the back box 230 in the illustrated embodiment, including a battery pack 240, a light emitting diode driver 235, and an egress module 245. The battery pack 240 can be of a reduced size to power only the lower power discrete light emitting diodes 125 in an emergency operation mode as described previously. The light emitting diode driver 235 controls power delivery to the chip-on-board light emitting diodes 120 in a normal operation mode. If the discrete light emitting diodes 125 are also illuminated in the normal operation mode, the light emitting diode driver 235 can control the delivery of power to the discrete light emitting diodes 125 as well. The egress module 245 detects a loss of utility power and controls the transfer from a normal operation mode to an emergency operation mode. Although not visible in the view of FIG. 3, the back box 230 also includes wiring for delivery of the utility power and the power from the battery pack 240.

In an example embodiment, an egress module's "emergency" operation can proceed as follows: The egress module 245 uses a voltage divider/rectifier to divide down the input voltage. The divided-down voltage is fed into the base of a transistor. When the voltage drops below a preset level, the transistor turns off. This releases the base of another transistor and turns it on. Current is then allowed to flow from the battery pack 240 through a constant current LED drive circuit (e.g. of the light emitting diode driver 235), turning on the discrete LEDs 125. When the battery voltage drops below a preset level, the LED drive circuit will turn the LEDs 125 off.

The teaching provided herein supports numerous embodiments, some of which will now be further discussed, without limitation.

Example embodiments of a luminaire are disclosed. In some of those disclosed embodiments, the luminaire can comprise a light cavity and a back box. The light cavity can comprise a reflector, a chip-on-board light emitting diode, and a plurality of discrete light emitting diodes. The back box can comprise a battery pack, a driver, and an egress module.

In some example embodiments of the luminaire, the chip-on-board light emitting diode and the plurality of discrete light emitting diodes are both illuminated in a normal operation mode and only the plurality of discrete light emitting diodes are illuminated in an emergency operation mode. In some example embodiments of the luminaire, only the chip-on-board light emitting diode is illuminated in a normal operation mode and only the plurality of discrete light emitting diodes are illuminated in an emergency operation mode. In some example embodiments, the luminaire comprises a plurality of chip-on-board light emitting diodes. In some example embodiments, the luminaire further comprises a housing for the back box and the light cavity, and a lens covering the light cavity. In some example embodiments, the luminaire further comprises: a housing in which the back box and the light cavity are disposed, the housing functioning as a heat sink and comprising an external surface with fins; and a lens covering the light cavity. In some example embodiments of the luminaire, when the plurality of discrete light emitting diodes and the chip-on-board light emitting diode are both illuminated, the plurality of discrete light emitting diodes consume less energy than the chip-on-board light emitting diode.

Additional example embodiments of a luminaire are disclosed. In some of those disclosed embodiments, the luminaire can comprise: a housing; a chip-on-board light emitting diode disposed in the housing and oriented to emit light from an aperture of the housing; a plurality of discrete light emitting diodes disposed in the housing and oriented to emit light from the aperture of the housing; and an electrical system electrically coupled to the chip-on-board light emitting diode and to the plurality of discrete light emitting diodes. The electrical system can be configured to: power the chip-on-board light emitting diode when utility power is available; and power the plurality of discrete light emitting diodes without powering the chip-on-board light emitting diodes when the utility power is not available.

In some example embodiments of the luminaire, powering the chip-on-board light emitting diode when utility power is available comprises powering the chip-on-board light emitting diode and the plurality of discrete light emitting diodes when utility power is available. In some example embodiments of the luminaire, powering the chip-on-board light emitting diode when utility power is available comprises powering the chip-on-board light emitting diode without powering the plurality of discrete light emitting diodes when utility power is available. In some example embodiments of the luminaire, the electrical system comprises a battery pack disposed in the housing, and the battery pack is sized for supplying power exclusively to the discrete light emitting diodes for a predetermined amount of time when the utility power is not available. In some example embodiments of the luminaire, the electrical system is further configured to detect a loss of utility power and transfer the luminaire from a normal operation mode to an emergency operation mode. In some example embodiments of the luminaire, the normal operation mode comprises powering the chip-on-board light emitting diode, and the emergency operation mode comprises powering the plurality of discrete light emitting diodes without powering the chip-on-board light emitting diodes.

Additional example embodiments of a luminaire are disclosed. In some of those disclosed embodiments, the luminaire can comprise: a housing; a chip-on-board light emitting diode disposed in the housing and oriented to emit light from an aperture of the housing; a plurality of discrete light emitting diodes disposed in the housing and oriented to emit light from the aperture of the housing; and an electrical system that is electrically coupled to the chip-on-board light emitting diode and to the plurality of discrete light emitting diodes and that is configured to transfer the luminaire from a normal operation mode to an emergency operation mode. The normal operation mode can comprise powering the chip-on-board light emitting diode, and the emergency operation mode can comprise powering the plurality of discrete light emitting diodes without powering the chip-on-board light emitting diodes.

In some example embodiments of the luminaire, the normal operation mode comprises powering the chip-on-board light emitting diode and the plurality of discrete light emitting diodes. In some example embodiments of the luminaire, the normal operation mode comprises powering the chip-on-board light emitting diode without powering the plurality of discrete light emitting diodes. In some example embodiments of the luminaire, powering the chip-on-board light emitting diode comprises powering the chip-on-board light emitting diode with utility power. In some example embodiments of the luminaire, powering the plurality of discrete light emitting diodes in the emergency operation mode comprises powering the plurality of discrete light emitting diodes from a battery. In some example embodiments of the luminaire, the battery is disposed in the housing. In some example embodiments, the luminaire, further comprises a battery pack disposed in the housing, the battery pack sized for powering the plurality of discrete light emitting diodes for a specified amount of time in the emergency operation mode, and the plurality of discrete light emitting diodes have a lower rate of energy consumption than the chip-on-board light emitting diode.

Many modifications and other embodiments of the disclosures set forth herein will come to mind to one skilled in the art to which these disclosures pertain having the benefit of the teachings presented in the foregoing descriptions and the associated drawings. Therefore, it is to be understood that the disclosures are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A luminaire comprising:

a light cavity comprising:

a reflector;

one or more first light emitting diodes disposed in the cavity to emit a first distribution of light; and one or more second light emitting diodes disposed in the cavity to emit a second distribution of light that is different than the first distribution of light;

a lens covering the light cavity; and a back box comprising an electrical system that comprises a battery pack, a driver, and an egress module and that is configured to power the one or more first light emitting diodes when utility power is available to the luminaire and to power the one or more second light emitting diodes without powering the one or more first light emitting diodes when the utility power is not available to the luminaire, wherein the back box is configured for mounting to a wall so that the light cavity faces downward.

2. The luminaire of claim 1, wherein the one or more first light emitting diodes and the one or more second light emitting diodes are both illuminated in a normal operation mode and only the one or more second light emitting diodes are illuminated in an emergency operation mode, wherein the one or more first light emitting diodes comprise two chip-on-board light emitting diodes that are inset in two respective areas of the reflector, wherein the two respective areas of the reflector are disposed adjacent one another, and wherein each respective area of the reflector has a V-shaped outline as viewed through the lens.

3. The luminaire of claim 1, wherein only the one or more first light emitting diodes are illuminated in a normal operation mode and only the one or more second light emitting diodes are illuminated in an emergency operation mode.

4. The luminaire of claim 1, wherein the reflector comprises a first curved portion and a second curved portion, wherein a first of the one or more first light emitting diodes is inset in the first curved portion and a second of the one or more first light emitting diodes is inset in the second curved portion.

5. The luminaire of claim 4, further comprising a housing, comprising vertically extending fins, for the back box and the light cavity, wherein the first curved portion and the second curved portion meet to form a corner that extends along a line between the first and the second of the one or more first light emitting diodes.

6. The luminaire of claim 1, further comprising a housing in which the back box and the light cavity are disposed, the housing functioning as a heat sink and comprising an external surface with fins.

7. The luminaire of claim 1, wherein when the one or more second light emitting diodes and the one or more first light emitting diodes are both illuminated, the one or more second light emitting diodes consume less energy than the one or more first light emitting diodes.

8. A luminaire comprising:

a first housing portion;

a second housing portion comprising a back box to which the first housing portion is removably coupled so that the back box can be mounted to a wall during luminaire installation and then the first housing portion can be attached to the mounted back box to complete the luminaire installation;

a reflector that is mounted at a lower end of the first housing portion and that forms a cavity;

a first light emitting diode disposed in the cavity of the first housing portion, and oriented to emit light in a specified direction from the cavity of the first housing portion;

a second light emitting diode disposed in the first housing portion and oriented to emit light from the cavity of the first housing portion; and an electrical system that is disposed in the back box and that is electrically coupled to the first light emitting diode and to the second light emitting diode, wherein the electrical system is configured to:

power the first light emitting diode when utility power is available; and power the second light emitting diode without powering the first light emitting diode when the utility power is not available.

9. The luminaire of claim 8, wherein powering the first light emitting diode when utility power is available comprises powering the first light emitting diode and the second light emitting diode when the utility power is available.

10. The luminaire of claim 8, wherein powering the first emitting diode when utility power is available comprises powering the first light emitting diode without powering the second light emitting diode when the utility power is available.

11. The luminaire of claim 8, wherein the electrical system comprises a battery pack disposed in the back box, and wherein the battery pack is sized for supplying power exclusively to the second light emitting diode for a predetermined amount of time when the utility power is not available.

12. The luminaire of claim 8, wherein the electrical system is further configured to detect a loss of utility power and transfer the luminaire from a normal operation mode to an emergency operation mode.

13. The luminaire of claim 12, wherein the normal operation mode comprises powering the first light emitting diode, wherein the emergency operation mode comprises powering the second light emitting diode without powering the first light emitting diode, and wherein the second light emitting diode comprises an array of discrete light emitting diodes.

14. A luminaire comprising:

a housing comprising a front housing portion and a back box to which the front housing portion is removably coupled so that the back box can be mounted to a wall during luminaire installation and then the front housing portion can be attached to the mounted back box to complete the luminaire installation;

a first light emitting diode disposed in the front housing portion and oriented to emit light from an aperture of the front housing portion;

a second light emitting diode disposed in the front housing portion and oriented to emit light from the aperture of the front housing portion; and an electrical system that is disposed in the back box and electrically coupled to the first light emitting diode and to the second light emitting diode and that is configured to transfer the luminaire from a normal operation mode to an emergency operation mode, wherein the normal operation mode comprises powering the first light emitting diode, and wherein the emergency operation mode comprises powering the second light emitting diode without powering the first light emitting diode.

15. The luminaire of claim 14, wherein the normal operation mode comprises powering the first light emitting diode and the second light emitting diode.

16. The luminaire of claim 14, wherein the normal operation mode comprises powering the first light emitting diode without powering the second light emitting diode.

17. The luminaire of claim 14, wherein powering the first light emitting diode comprises powering the first light emitting diode with utility power.

18. The luminaire of claim 17, wherein powering the second light emitting diode in the emergency operation mode comprises powering the second light emitting diode from a battery.

19. The luminaire of claim 18, wherein the battery is mounted in the back box.

20. The luminaire of claim 14, further comprising a battery pack disposed in the back box, the battery pack sized for powering the second light emitting diode for a specified amount of time in the emergency operation mode, and wherein the second light emitting diode has a lower rate of energy consumption than the first light emitting diode.

* * * * *